US012158061B1

(12) United States Patent
Koon

(10) Patent No.: US 12,158,061 B1
(45) Date of Patent: Dec. 3, 2024

(54) ELECTRICAL CONTACT DESIGN FOR A PERFORATING GUN

(71) Applicant: Steel Dog Industries Inc., Charleroi, PA (US)

(72) Inventor: Jason R. Koon, Charleroi, PA (US)

(73) Assignee: Steel Dog Industries Inc., Charleroi, PA (US)

( * ) Notice: Subject to any disclaimer, the term of this patent is extended or adjusted under 35 U.S.C. 154(b) by 190 days.

(21) Appl. No.: 17/867,842

(22) Filed: Jul. 19, 2022

Related U.S. Application Data

(60) Provisional application No. 63/241,728, filed on Sep. 8, 2021.

(51) Int. Cl.
*E21B 43/1185* (2006.01)
*F42D 1/055* (2006.01)

(52) U.S. Cl.
CPC ..... *E21B 43/1185* (2013.01); *F42D 1/055* (2013.01)

(58) Field of Classification Search
CPC .... E21B 43/1185; E21B 43/116; E21B 43/11; F42D 1/055; F42D 1/05; F42D 1/045; F42B 3/10
See application file for complete search history.

(56) References Cited

U.S. PATENT DOCUMENTS

| | | | | |
|---|---|---|---|---|
| 5,046,567 | A * | 9/1991 | Aitken | F42D 1/04 166/299 |
| 10,352,136 | B2 * | 7/2019 | Goyeneche | E21B 43/117 |
| 10,396,448 | B2 * | 8/2019 | Schmutzler | H01Q 1/42 |
| 10,689,955 | B1 * | 6/2020 | Mauldin | F16C 35/06 |
| 10,920,543 | B2 * | 2/2021 | Eitschberger | E21B 43/119 |
| 11,674,370 | B2 * | 6/2023 | Shelton | E21B 43/117 166/297 |
| 11,828,143 | B2 * | 11/2023 | Koon | F42B 3/02 |
| 11,913,767 | B2 * | 2/2024 | Sullivan | F42B 3/10 |
| 2020/0088011 | A1 * | 3/2020 | Eitschberger | G01R 27/205 |
| 2020/0248535 | A1 * | 8/2020 | Goyeneche | E21B 17/028 |
| 2021/0310340 | A1 * | 10/2021 | Sansing | F42D 1/04 |
| 2022/0099423 | A1 * | 3/2022 | Sullivan | E21B 43/1185 |
| 2022/0186588 | A1 * | 6/2022 | Shelton | E21B 43/117 |
| 2022/0251930 | A1 * | 8/2022 | Koon | E21B 43/119 |
| 2023/0045109 | A1 * | 2/2023 | Goyeneche | E21B 43/119 |

* cited by examiner

*Primary Examiner* — Daniel P Stephenson
(74) *Attorney, Agent, or Firm* — Lippes Mathias LLP

(57) ABSTRACT

End cap assemblies for retaining the through-pin of a tandem sub are disclosed. An electrical contact attachment is attached or mounted to an end cap, having an opening for receiving the through-pin, and one or more pin contact tabs in the opening. The contact attachment also includes an aperture for passing a first wire therethrough, and an insert for securing an electrically conductive wire to the electrical contact attachment itself.

20 Claims, 14 Drawing Sheets

ELECTRICAL CONTACT DESIGN FOR A PERFORATING GUN

CROSS-REFERENCE TO RELATED APPLICATIONS

This application claims priority to U.S. Provisional Patent Application Ser. No. 63/241,728, filed on Sep. 8, 2021, which is incorporated by reference in its entirety.

BACKGROUND

The present disclosure relates to devices useful in assembling a perforating gun. Such devices include various components for end caps that include an electrical contact for mating with a tandem sub. These devices increase user efficiency, ensure a more secure pin-to-contact connection, and reduce costs.

Oil and gas exploration and production, as well as other subterranean activities (e.g., water exploration and extraction), involve drilling and completing a wellbore. The wellbore is drilled into the ground and then can be lined with metal pipe generally referred to as casing. The casing may also be cemented in place, sealing the annulus between the casing and the earthen formation.

To create flow paths between the wellbore and the formation, a perforating gun is used. Perforating guns are tubular-shaped devices having an outer housing that holds one or more interconnected charge carriers. The charge carrier holds multiple shaped explosive charges ("shots") positioned about the circumference thereof and aimed in a radial direction.

To detonate the shaped charges, the perforating gun includes an addressable switch for each charge carrier. The addressable switch receives an electrical signal that is transmitted from the surface and/or from another location, and then initiates a detonator to ignite a detonating cord. The detonating cord extends through the charge carrier and is interconnected with the shaped charges held by the charge carrier. When detonated, the shaped charges create perforations through the wellbore casing, cement and into the earthen formation.

BRIEF DESCRIPTION

Disclosed in the present disclosure are various devices and components for creating a secure connection between the electrically conductive through-pin of a tandem sub and an end cap assembly of a charge carrier.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

FIG. 2A is a plan view of the contact attachment.

FIG. 2B is an upper perspective view of the contact attachment.

FIG. 2C is a side view of the contact attachment.

FIG. 6A is a front perspective view of the end cap assembly.

FIG. 6B is a rear perspective view of the end cap assembly.

FIG. 6C is a side cross-sectional view of the end cap assembly.

DETAILED DESCRIPTION

Figure 1A:
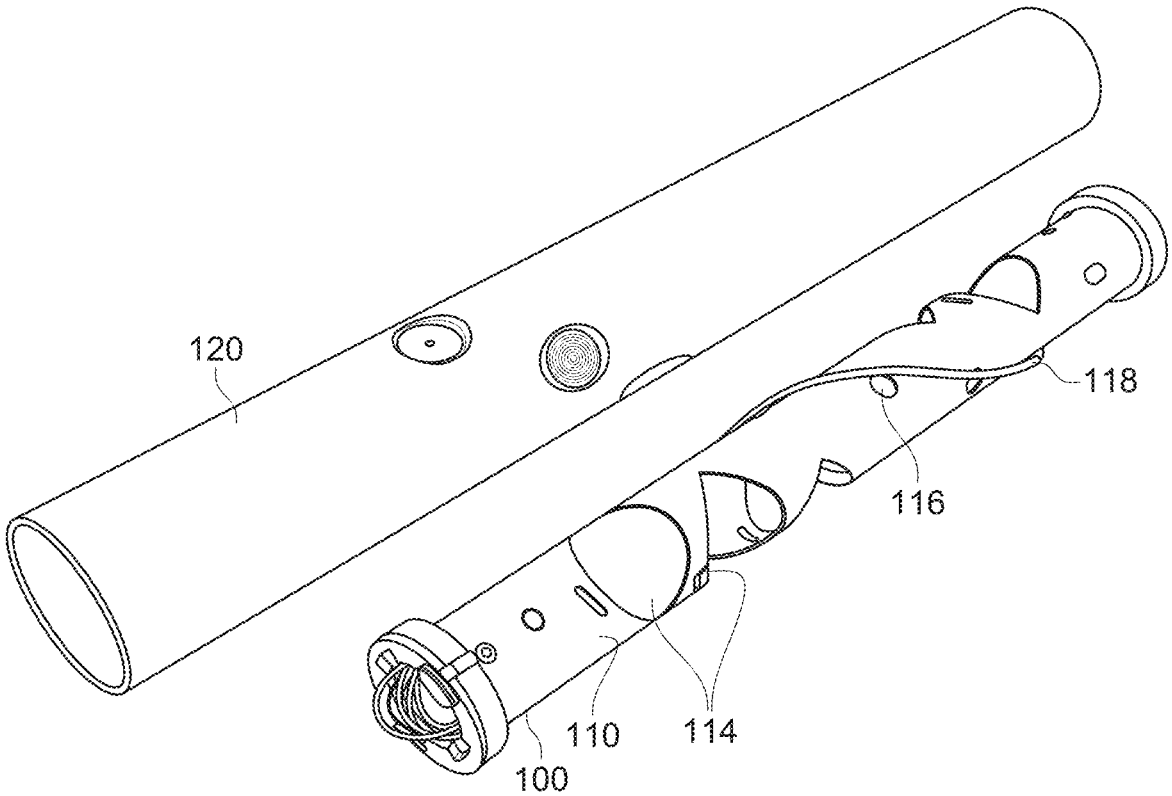
FIG. 1A (PRIOR ART)
FIG. 1A is a perspective view of a conventional charge carrier and a gun barrel, separated from each other.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the terms "comprise(s)," "include(s)," "having," "has," "can," "contain(s)," and variants thereof, as used herein, are intended to be open-ended transitional phrases, terms, or words that require the presence of the named components/ingredients/steps and permit the presence of other components/ingredients/steps. However, such description should be construed as also describing systems or devices or compositions or processes as "consisting of" and "consisting essentially of" the enumerated components/ingredients/steps, which allows the presence of only the named components/ingredients/ steps, along with any unavoidable impurities that might result therefrom, and excludes other components/ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

A value modified by a term or terms, such as "about" and "substantially," may not be limited to the precise value specified. The modifier "about" should also be considered as disclosing the range defined by the absolute values of the two endpoints. For example, the expression "from about 2 to about 4" also discloses the range "from 2 to 4." The term "about" may refer to plus or minus 10% of the indicated number.

It should be noted that many of the terms used herein are relative terms. For example, the terms "upper" and "lower" are relative to each other in location, i.e. an upper component is located above a lower component in a given orientation. The terms "top" and "bottom" or "base" are also relative to each other, as are the terms "upward" and "downward". Some of the components described herein can be inverted, so that such relative terms are appropriate.

The term "vertical" is used to indicate direction relative to an absolute reference, i.e. ground level. However, this term should not be construed to require structures to be absolutely parallel or absolutely perpendicular to each other.

As used herein, the term "parallel" should be construed in its lay sense of two surfaces that maintain a generally constant distance between them, and not in the strict mathematical sense that such surfaces will never intersect when extended to infinity. Similarly, the term "perpendicular" should be construed in the lay sense of two components having an angle of approximately 90° between them.

The present disclosure relates to devices and methods for retaining an electrically conductive through-pin of a tandem sub in reliable engagement with an end cap, and various components used therewith. The components described herewith are believed to be more reliable than a standard spring mechanism which can bend and flex when the through pin is inserted, potentially breaking the electrically conductive pathway between the tandem sub and the charge carrier. Conventional devices are first described for background and comparative purposes, and the methods and devices of the present disclosure are described thereafter.

FIG. 1A is a perspective view of a charge carrier 100 and a barrel 120, separated from each other. The charge carrier 100 is in the form of a long cylindrical tube defined by a sidewall 110. The sidewall includes a number of cutouts 114 for shots, which are set so that the shot explodes radially, i.e. perpendicular to the sidewall. Six cutouts are visible in the various views, although the number can vary. A smaller sized opening 116 is directly opposite each of the cutouts. The shots in each charge carrier are joined together by a detonator cord (not shown) which wraps around the exterior of the charge carrier and is attached to the back of each shot. A through wire 118 also wraps around the exterior of the charge carrier, usually next to the detonator cord. In operation, the charge carrier 100 is placed within the barrel 120. The two ends of the barrel include internal threads (not visible) which are used to engage a tandem sub. A perforating gun is formed from a series of charge carriers/barrels and tandem subs, with an addressable switch present for each charge carrier.

Figure 1B:
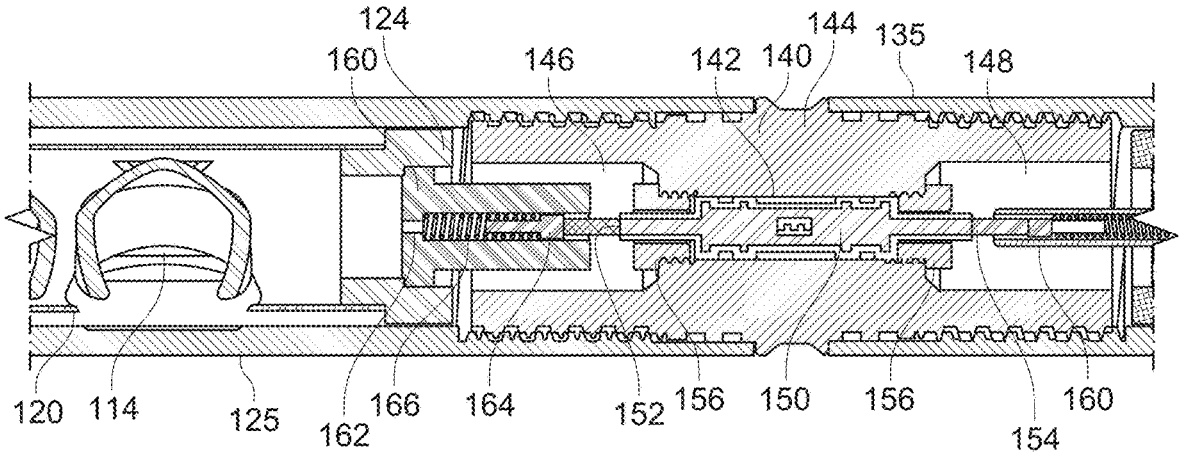
FIG. 1B (PRIOR ART)
FIG. 1B is a cross-sectional view showing two conventional charge carriers with end caps engaging a pin-to-pin tandem sub.

FIG. 1B is a cross-sectional view showing an assembly of two barrels 125, 135 joined together using a pin-to-pin tandem sub 140. Two end caps 160 are depicted as engaging the pin-to-pin tandem sub 140. On the left-hand side, end cap 160 engages an end plate 124 of first charge carrier 120. The first charge carrier 120 is surrounded by and located within first barrel 125. On the right-hand side, part of a second end cap 160 and the second barrel 135 are visible. A second charge carrier (not seen) is also present within the second barrel. The pin-to-pin tandem sub 140 joins the two barrels 125, 135 together.

Referring now to the tandem sub 140, a shaft 142 extends entirely through a main body 144 from a first end to a second end thereof. The electrically-conductive through-pin 150 is fixed in place within the shaft. The shaft 142 has the same diameter at both ends. The ends 152, 154 of the through-pin are exposed at the first end and the second end of the main body. A first end 152 of the through-pin is present within the box 146 at the first end of the main body. A second end 154 of the through-pin is present within the box 148 at the second end of the main body. The through-pin 150 is fixed in place by nuts 156 that secure the through-pin at each end. The ends 152, 154 of the through-pin engage the end caps 160 located within the two charge carriers 120, 130 and permit an electrical signal to be passed between the two charge carriers.

Also visible on the left-hand side is the internal structure of the end cap 160. As seen here, the end cap includes an internal shaft 162 which encloses a thru-pin 164 and a spring 166. The thru-pin and spring are electrically conductive, and engage the through-pin 150 of the tandem sub. Thus, an electrical signal can pass from the tandem sub to the charge carrier through the end cap, and vice versa.

Electrical signal is transmitted from the tandem sub through the thru pin and spring in the end cap. The transmitted electrical signal must also pass through upstream charge carriers to arrive at downstream carriers. Thus, consistency and reliability of the electrical signals are important in the successful operation of the perforating gun. Due to the flexibility of the spring, the spring might not maintain a secure connection with the thru pin and interrupt the flow of electrical current. This is not desirable.

The present disclosure thus relates to end cap assemblies and electrical contacts which are not as flexible, and thus ensure a more reliable connection for the transmission of electrical signal. The end cap assemblies include a main cap and an electrical contact attachment, and optionally may also include a cover cap. These structures are discussed in more detail below.

Figure 2A:
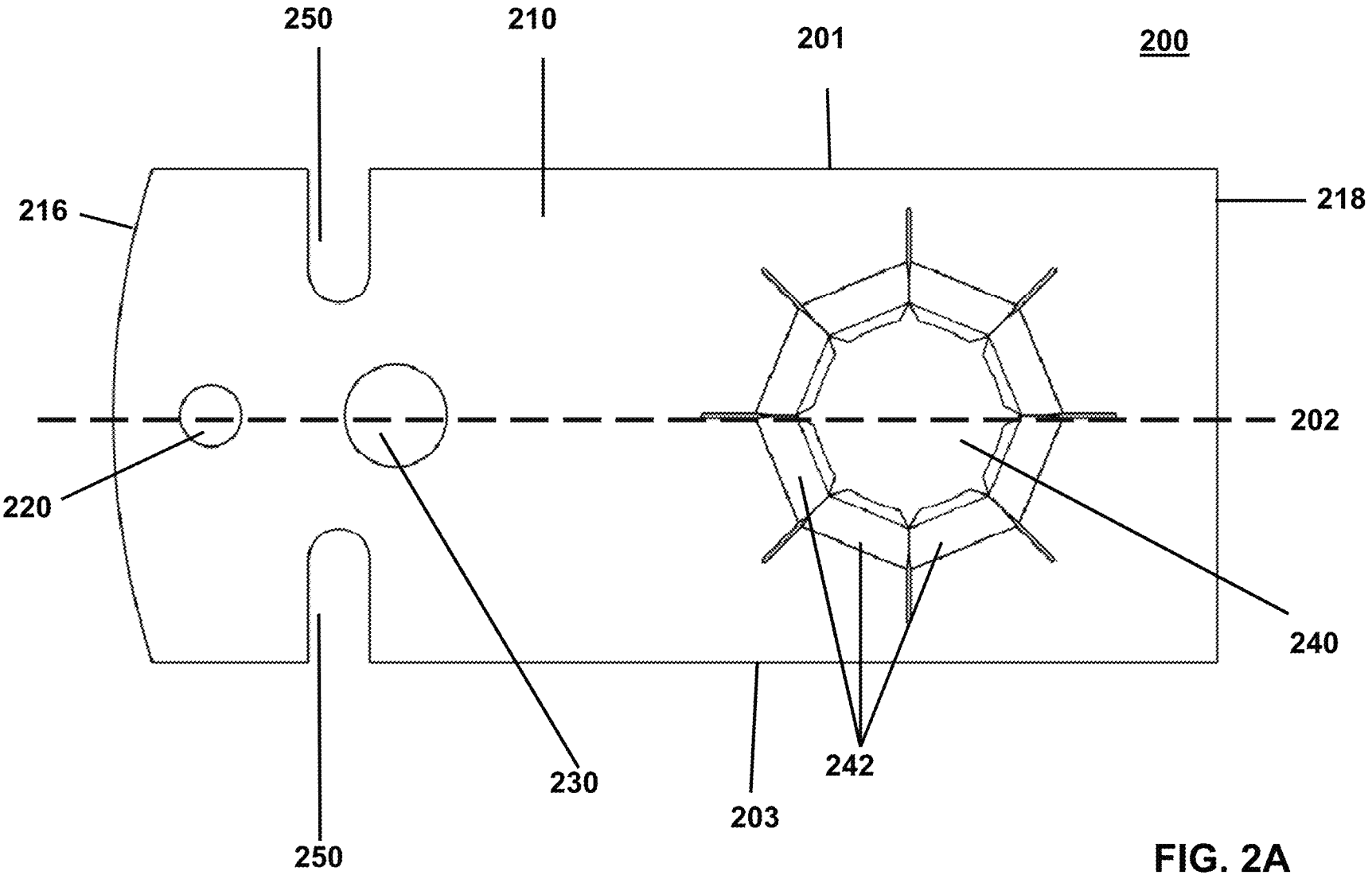
FIGS. 2A-2C are various views of one embodiment of an electrical contact attachment of the present disclosure. This contact attachment engages the electrically conductive through-pin of the tandem sub.
Figure 2B:
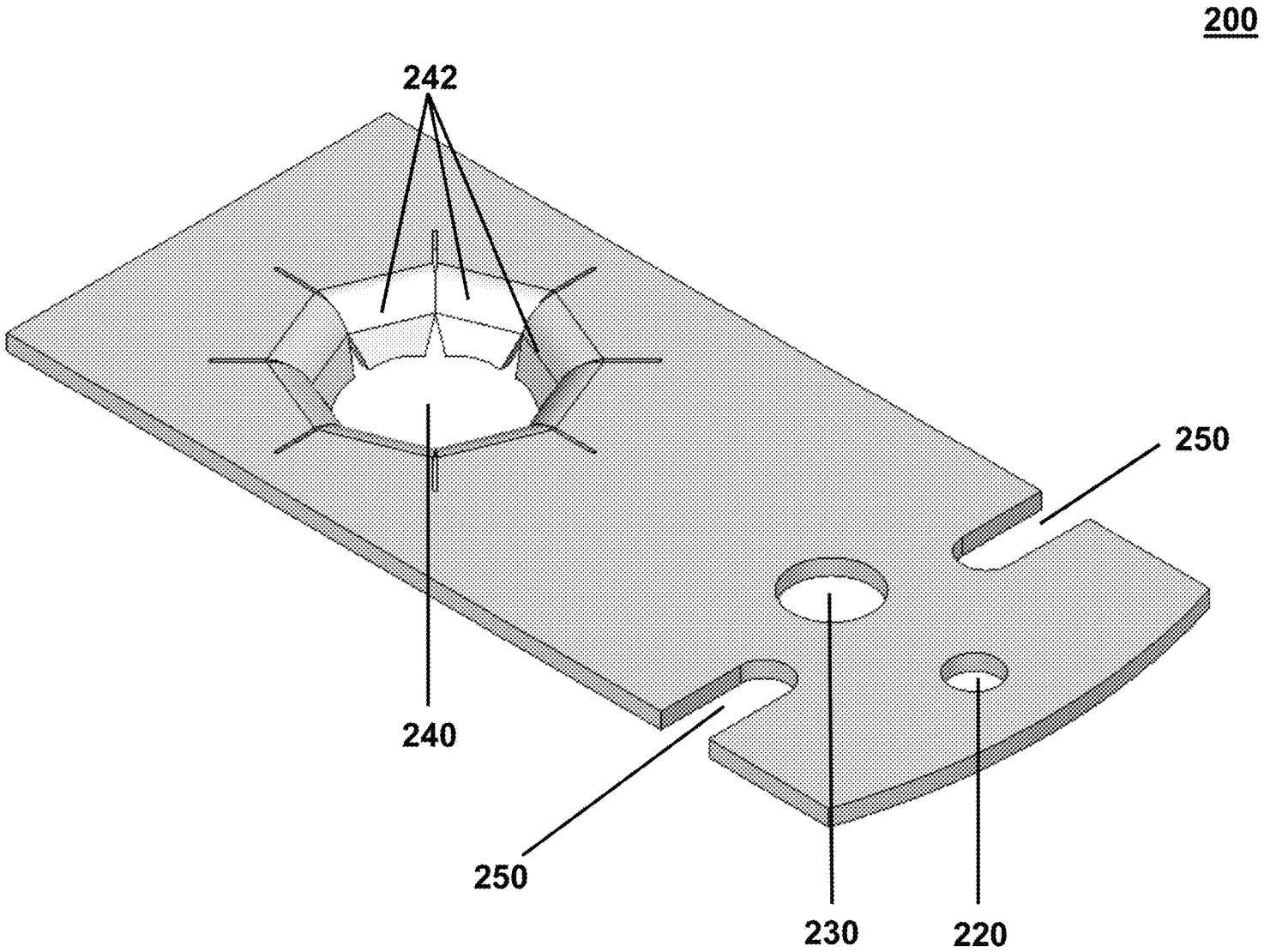
Figure 2C:
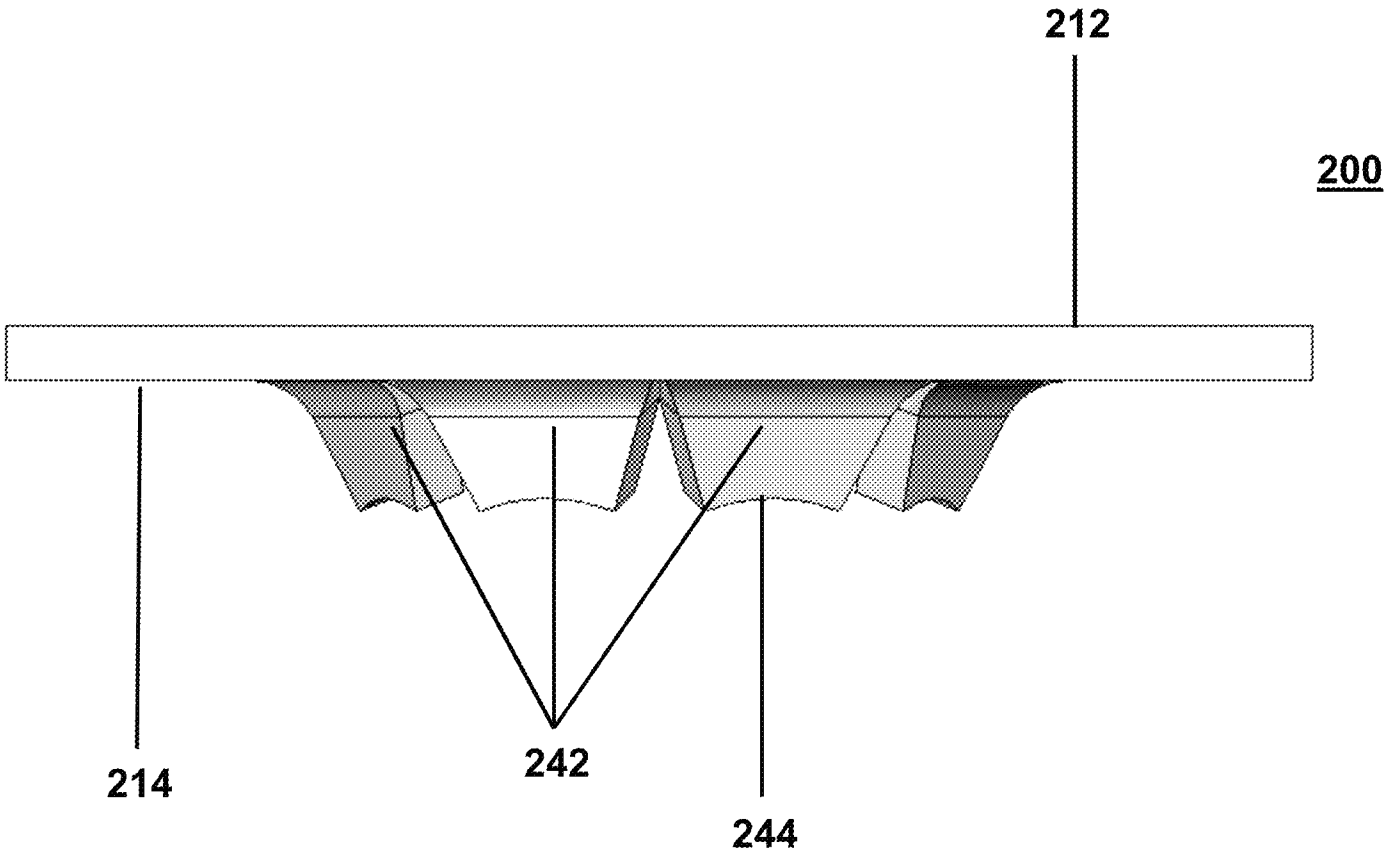

FIGS. 2A-2C show one embodiment of an electrical contact attachment 200 of the present disclosure. FIG. 2A is a plan view of the contact attachment. FIG. 2B is an upper, side perspective view of the contact attachment. FIG. 2C is a side view of the contact attachment.

Referring now to all three figures, the contact attachment 200 comprises a body 210 with a first end 216 and a second end 218 opposite the first end. The body can be considered generally rectangular, with a longitudinal axis 202 extending in the direction from the first end to the second. In some embodiments as illustrated here, the edge of the contact attachment at the first end 216 is radially curved in a convex shape. This conforms to the shape of the main cap, as will be discussed further herein. The body also includes a front surface 212 and a rear surface 214. The thickness of the body is generally constant between the front surface and rear surface extending from the first end to the second end, although this is not required.

On the contact attachment body 210, a wire insert aperture 220, a mounting aperture 230, and at least one cutout 250 are located proximate to the first end. The function of the wire insert aperture is to permit a wire to pass through the contact attachment. The function of the mounting aperture is to permit the contact attachment to be fastened to the main cap. The cutout is in the perimeter of the body, and serves the function of anchoring another wire which is secured to the contact attachment. The location of these three structures proximate the first end is not significant, so long as their function can be performed. As illustrated here, the wire insert aperture 220 is closer to the perimeter than the mounting aperture 230. In some particular embodiments, the mounting aperture has a larger diameter than the wire insert aperture.

In some embodiments, the wire insert aperture 220 is offset from the centerline. This moves the wire insert aperture closer to the outer perimeter of the end cap, which permits the end cap to be moved closer to the shots. This allows the overall length of the gun barrel to be shortened, which can reduce cost.

Two cutouts 250 are illustrated as being present on opposite sides 201, 203 of the body. In use, a wire is secured to the contact by tying around the cutout 250, then passes through the wire insert aperture 220 and is connected to the through wire (reference number 118 in FIG. 1A). The cutouts and the wire insert aperture in the contact attachment allow for easier and faster wire assembly through versatile wire securing methods such as welding, soldering, riveting, or gluing, tying, and other methods known in the art.

Proximate the second end 218 of the contact attachment body 210, a pin aperture 240 is present. In use, the pin aperture receives the electrically conductive through-pin of a tandem sub. The pin aperture 240 further comprises at least one contact tab 242 oriented radially inwards towards the center of the pin aperture. In more particular embodiments, a plurality of pin contact tabs is present, and in a specific embodiment as illustrated here, eight pin contact tabs are present. The pin aperture 240 extends through the entirety of the body 210.

Referring now to FIG. 2C, the front surface 212 and the rear surface 214 are more clearly seen here. The pin contact tabs 242 are shown here extending away from the body in the direction of the rear surface. It is also noted that the distal edge 244 of the pin contact tabs has a convex shape.

The pin contact tabs 242 can be made by first punching a small hole through the body 210. Perforations are then made radially away from the small hole to form the tabs, which are coplanar with the rest of the body in this initial state. The tabs are then bent downwards, either prior to engaging the electrically conductive through-pin or when the electrically conductive through-pin is inserted. The tabs may be considered to have a substantially trapezoidal shape.

This structure of the contact attachment eliminates the need for a spring anywhere in the electrical connection. Instead, the pin contact tabs grasp the electrically conductive through-pin of the tandem sub, offering a secure connection. The shape of the tabs also offer more surface area contacting the through-pin. They also act to grab onto the through-pin, making it more difficult for them to be separated during field usage.

Figure 3:
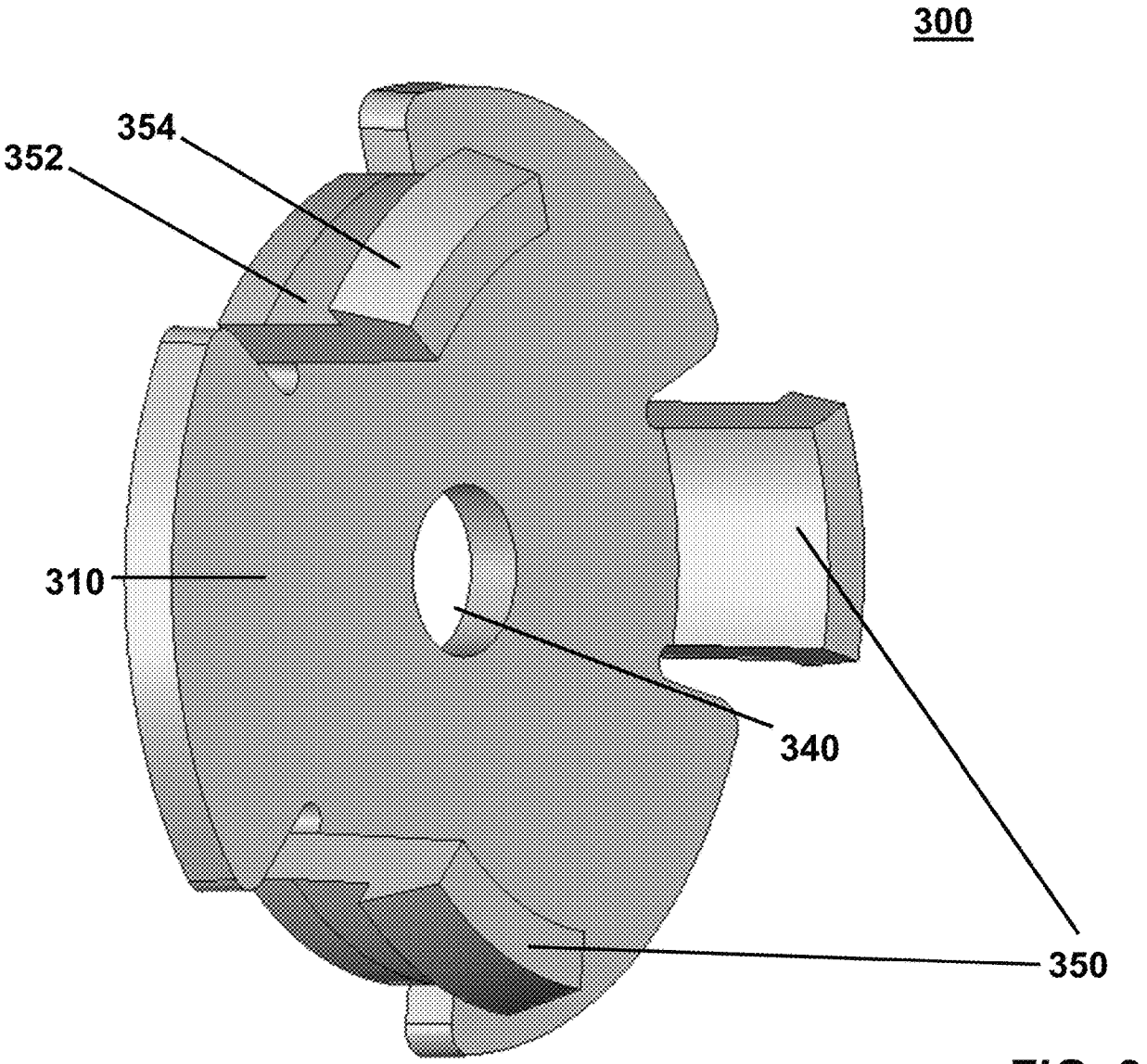
FIG. 3 is a rear perspective view of one embodiment of an optional cover cap of the present disclosure. When used, the cover cap can be used to secure the electrical contact attachment to the main cap.

FIG. 3 is a perspective view of one embodiment of an optional cover cap of the present disclosure. When used, the cover cap engages the main cap.

The cover cap 300 comprises a flat body 310, which is substantially circular in shape, and could alternatively be considered to be derived from a solid cylinder having a cylindrical sidewall and two parallel surfaces. A pin aperture 340 is present in the center of the body, which passes entirely through the body. A plurality of fasteners 350 are also present, extending in one direction normal to the flat body itself. The fasteners are spaced apart, and are located around the circumference of the body. As illustrated here, each fastener is part of a snap-fit joint having a male member and a female member (the male member being present on the cover cap). The male member is a cantilever, in the form of a beam 352 having a catch 354 at its distal end. This cantilever will engage a box having a stop surface or ledge on the main cap (as explained further herein).

Figure 4A:
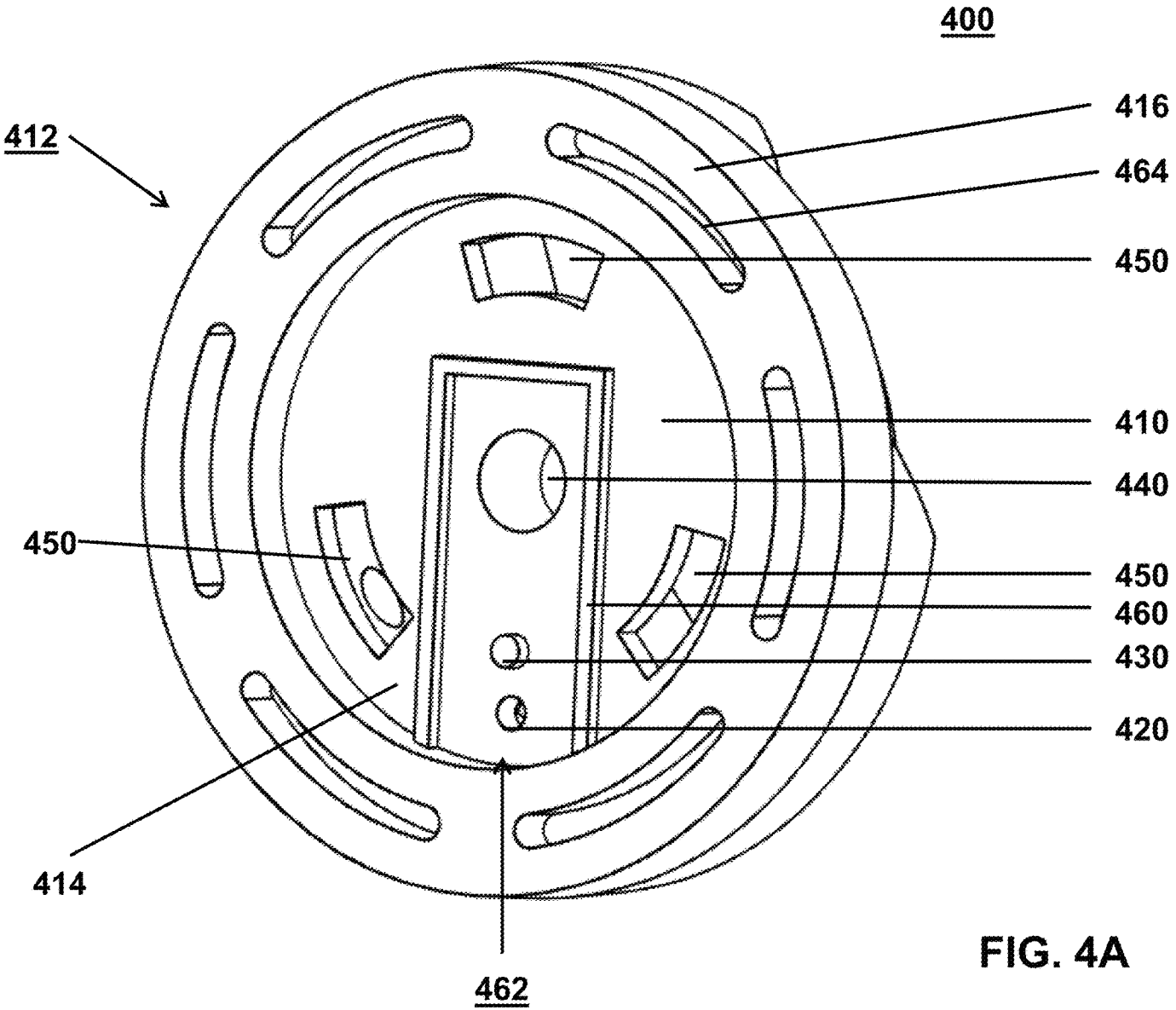
FIG. 4A is a front perspective view of one embodiment of a main cap of the present disclosure. The main cap is placed at a terminal end of an end cap.
Figure 4B:
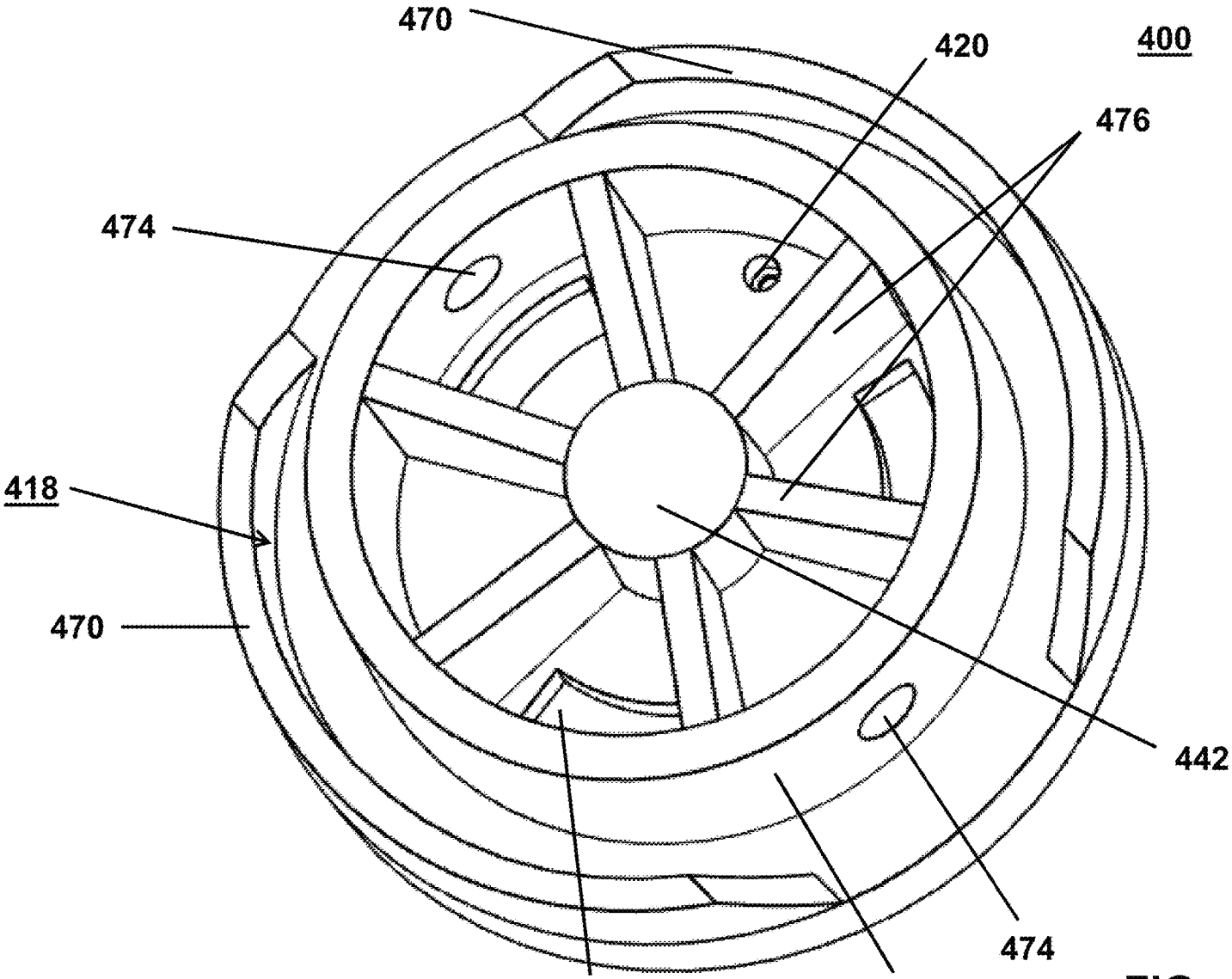
FIG. 4B is a rear perspective view of the main cap of FIG. 4A.

FIG. 4A is a front perspective view of one embodiment of a main cap of the present disclosure. FIG. 4B is a rear perspective view of the main cap. The main cap is placed at a terminal end of an end cap assembly.

Referring first to FIG. 4A, the main cap 400 comprises a flat body 410, which is substantially circular in shape, and could alternatively be considered to be derived from a solid cylinder having a cylindrical sidewall and two parallel surfaces. The front surface 412 of the body includes a recessed central surface 414 surrounded by an annular perimeter wall 416.

The recessed central surface 414 includes a wire insert aperture 420 which passes through the entirety of the body to the rear surface 418 of the body. The recessed central surface 414 also includes a mounting anchor 430. The wire insert aperture 420 is located so as to align with the wire insert aperture 220 of the contact attachment. The mounting anchor 430 is located so as to engage the mounting aperture 230 of the contact attachment. A pin bore 440 is also present in the center of the body and the recessed central surface. It is noted that the pin bore can extend through the entirety of the body, but does not have to. Finally, if desired, the recessed central surface may also include a ridge 460 that defines a contact attachment dock 462. When present, the pin bore 440, the mounting anchor 430, and the wire insert aperture 420 are located within the dock 462.

Optionally, when a cover cap 300 is used, the recessed central surface 414 may also include a plurality of fastener openings 450. Each fastener opening extends through the entirety of the body to the rear surface. The fastener openings are spaced apart from each other, and are located around the circumference of the recessed central surface. The fastener openings are intended to engage the fasteners of the cover cap. When present, the number of fastener openings in the main cap should equal or exceed the number of fasteners on the cover cap.

Continuing, the annular perimeter wall 416 may optionally include circumferential grooves 464 therein. These grooves are intended to reduce the amount of material needed to make the main cap.

Referring now to FIG. 4B, a plurality of arcuate collars 470 extend away from the rear surface 418 along the perimeter/circumference of the rear surface. The arc of these collars 470 is measured relative to the center of the main cap. In particular embodiments, the collars cover an arc of less than 180°. These collars are used to attach the main cap to the rest of the end cap. A cylindrical sidewall 472 also extends from the rear surface. The cylindrical sidewall has a smaller radius than the collars, and surrounds the pin bore 440. As illustrated here, a plurality of radial apertures 474 are present on opposite sides of the cylindrical sidewall, in locations not blocked by the collars 470. It is contemplated that these apertures may be threaded, and may also be used for attaching the main cap to the rest of the end cap.

The pin bore 440 itself is surrounded by a wall 442. Additional radial walls 476 extend radially between the pin bore wall 442 and the cylindrical sidewall 472, which can provide additional structural support. Six radial walls are shown here. Also visible in this view is the wire insert aperture 420, as well as the opposite side of the fastener openings 450.

Figure 5:
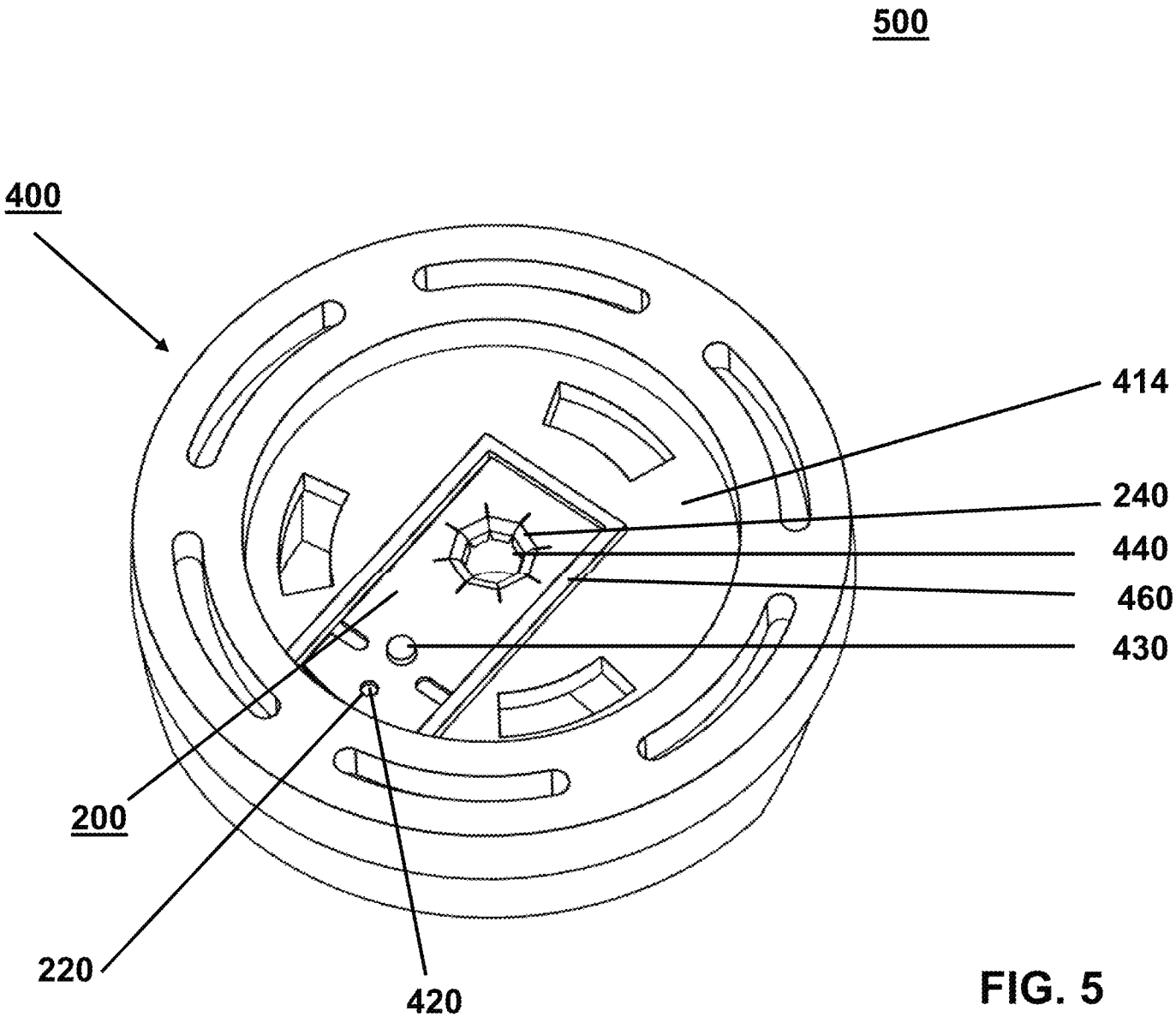
FIG. 5 is a perspective view of a first embodiment of an end cap assembly containing only a main cap and the contact attachment of the present disclosure. The main cap has a mounting anchor received in the mounting aperture of the contact attachment.

FIG. 5 is a front perspective view of an embodiment of an end cap assembly 500 formed from the main cap 400 engaging the contact attachment 200 of the present disclosure. In this embodiment, the end cap assembly is formed from only the main cap and the contact attachment, and does not include the cover cap. As depicted here, the mounting anchor 430 is in the form of a pin which passes through the mounting aperture 230 and holds the contact attachment in place against the main cap. For example, the mounting anchor may include a catch that keeps the contact attachment from separating when the main cap is turned upside down.

However, other methods for attaching the contact attachment to the main body are also contemplated. For example, as one alternative, an adhesive may be used to hold the two pieces together, with the pin providing extra surface area between the two pieces for the adhesive. As another alternative, the mounting anchor 430 could be a threaded bore that extends into the recessed central surface 414, and a fastener such as a screw could pass through the mounting aperture 230 of the contact attachment and engage the threaded bore.

Continuing, as seen here, the pin aperture 240 of the contact attachment 200 is concentric with the pin bore 440 of the main cap 400. The wire insert aperture 220 of the contact attachment 200 is also concentric with the wire insert aperture 420 of the main cap 400. The contact attachment 200 is located within the ridge 460 defining the contact attachment dock.

Figure 6A:
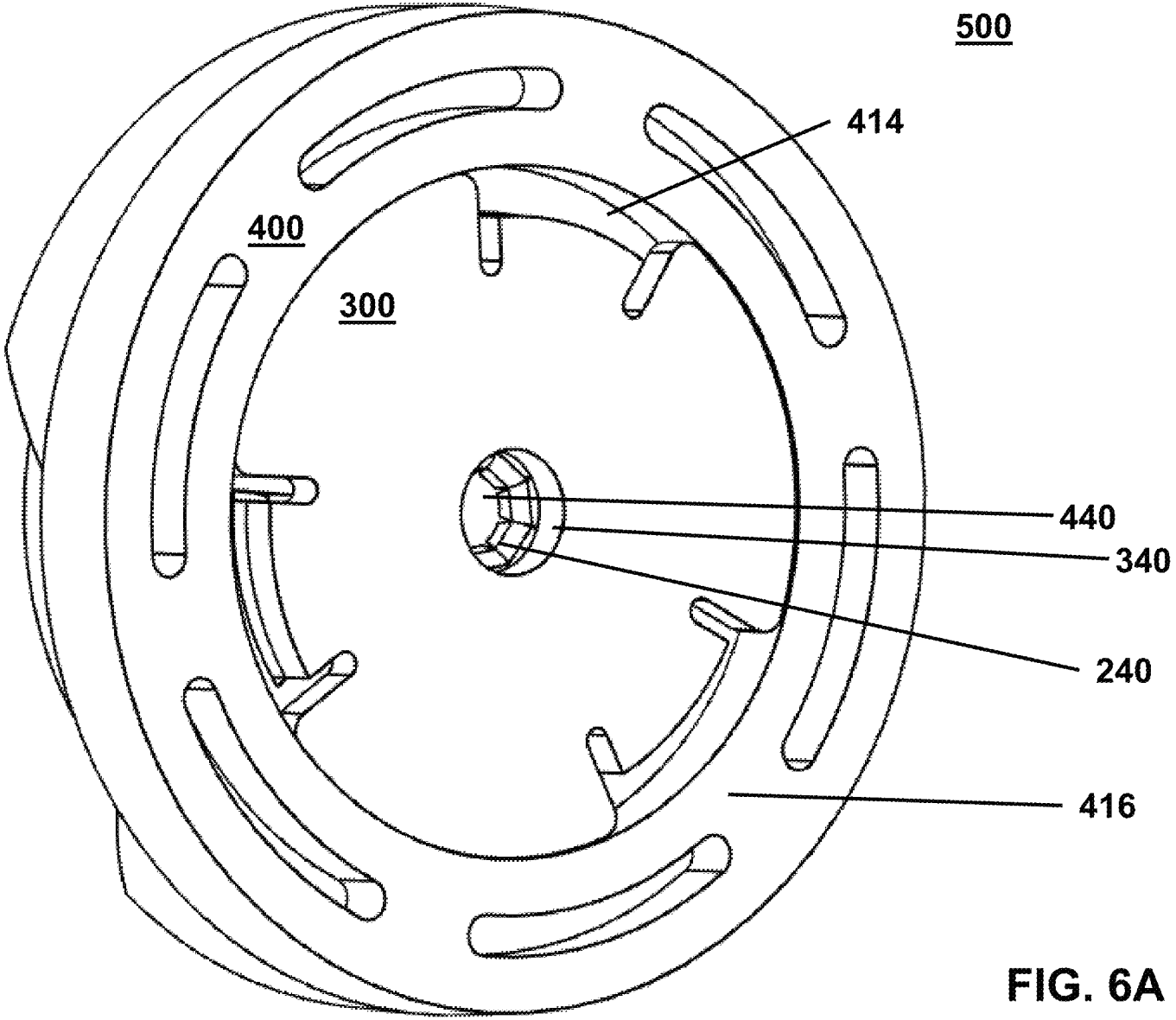
FIGS. 6A-6C are various views of a second embodiment of an end cap assembly of the present disclosure. This end cap assembly includes a cover cap, a main cap, and a contact attachment held in place between the cover cap and the main cap.
Figure 6B:
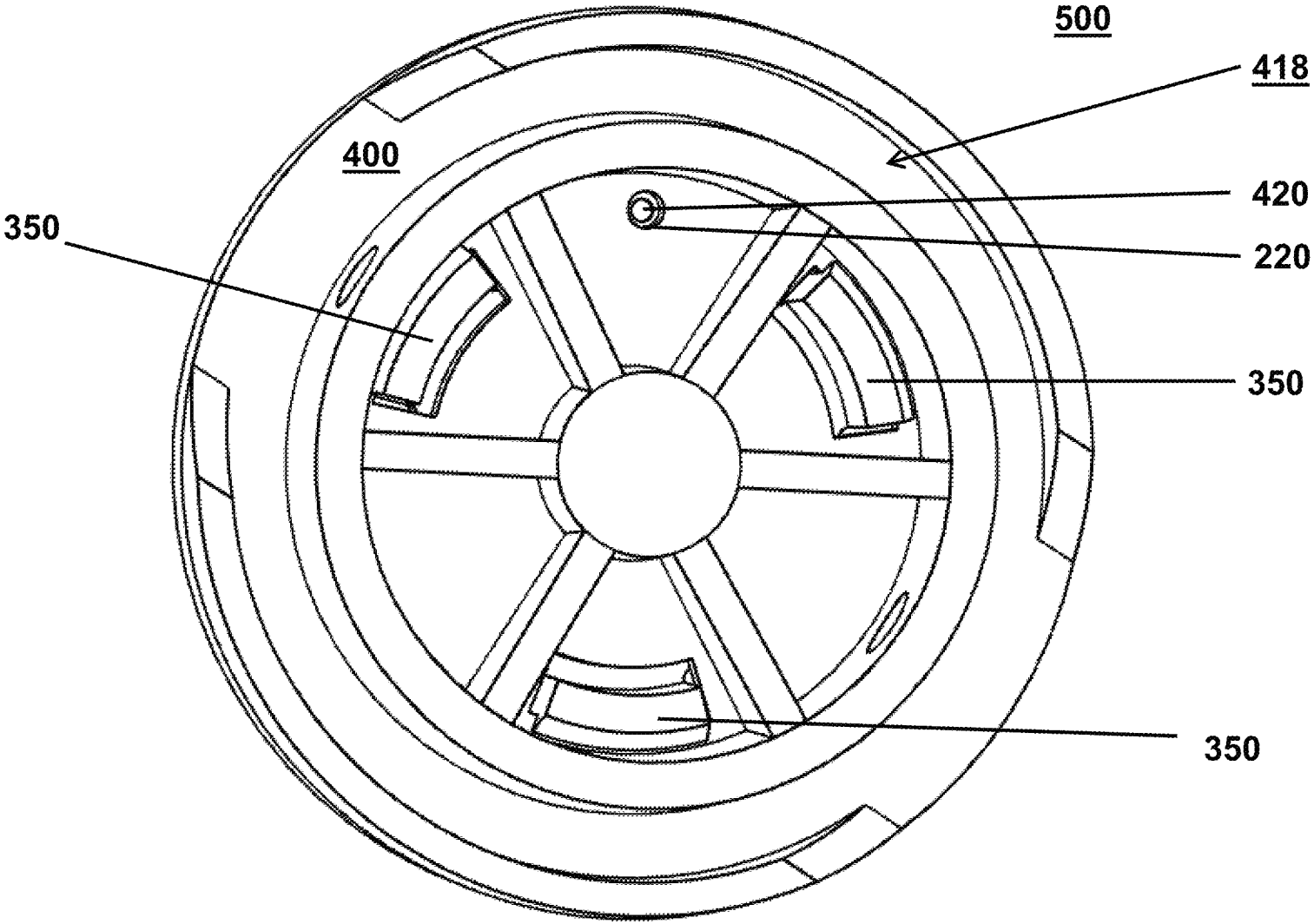
Figure 6C:
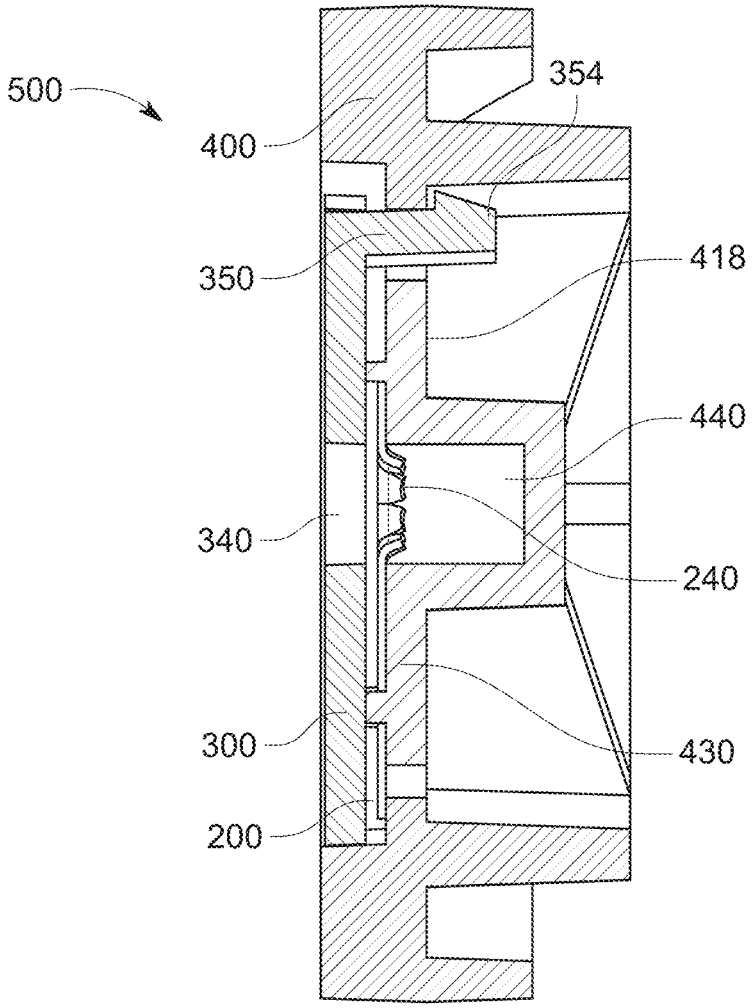

FIGS. 6A-6C are various views of another embodiment of an end cap assembly of the present disclosure. This embodiment 500 includes the main cap 400, the electrical contact attachment 200, and the cover cap 300. FIG. 6A is a front perspective view of the end cap. FIG. 6B is a rear perspective view of the end cap. FIG. 6C is a side cross-sectional view of the end cap.

Referring now to FIG. 6A, the cover cap pin aperture 340, the contact attachment pin aperture 240, and the main cap pin bore 440 are all concentric with each other. The cover cap 300 also fills the recessed central portion of the main cap 400, so that the surface of the body is substantially coplanar with the annular perimeter wall 416. Put another way, the thickness of the cover cap 300 is about equal to the height of the annular perimeter wall 416 relative to the recessed central surface 414, or about equal to the depth of the recessed central surface relative to the annular perimeter wall 416.

Referring now to FIG. 6B, the cover cap fasteners 350 pass through the main cap fastener openings 450 and engage the rear surface 418. The main cap wire insert aperture 420 and the contact attachment wire insert aperture 220 are also aligned with each other, as can be seen in this view.

Referring now to the side cross-sectional view of FIG. 6C, the concentricity of the cover cap pin aperture 340, the contact attachment pin aperture 240, and the main cap pin bore 440 is clearly visible. The engagement of the cover cap fastener catch 354 against the main cap rear surface 418 is also visible. It is also seen here that the cover cap secures the contact attachment to the main cap. Put another way, the contact attachment is held in place against the main cap by the cover cap. In this particular illustration, the mounting anchor 430 is simply a cylinder (without a catch) that passes through the mounting aperture 230 of the contact attachment 200.

The various end cap components, assemblies, and apparatuses of the present disclosure eliminate the need for a spring anywhere in the electrical connection, avoiding any problems with metal bending and flexing around the through-pin in the end cap.

Costs are also decreased by eliminating the need for CNC-turned contacts, and by being able to make the electrical contact attachment 200 out of electrically-conductive sheet metal cut by water jets, plasma tables, CNC routers, or laser cutters. The electrical contact attachment 200 can also be stamped out of sheet metal. The main cap 400 and the cover cap 300 can be made from suitable plastics, and can be mass-produced via injection molding or other methods known in the art.

Figure 7:
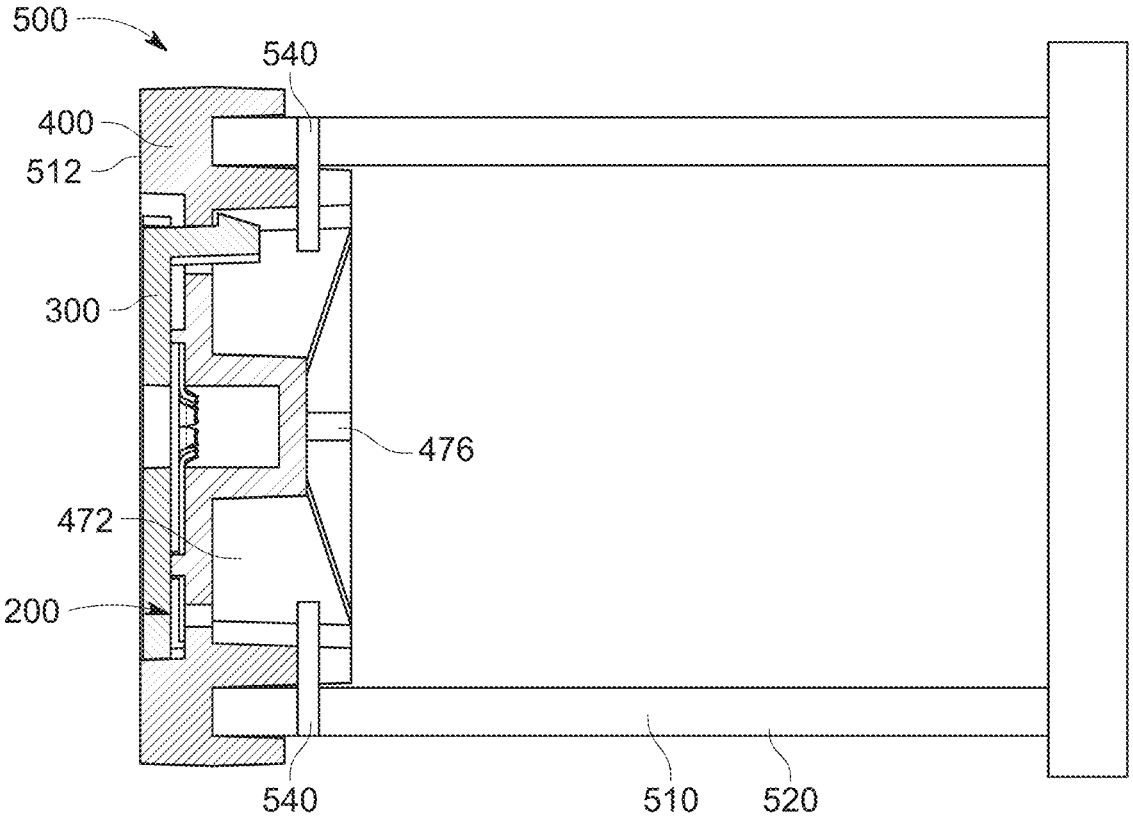
FIG. 7 is a side cross-sectional view showing the end cap assembly attached to an end cap body, to form an elongated end cap.

FIG. 7 is a side cross-sectional view showing the end cap assembly of FIGS. 6A-6C attached to an end cap body, to form an elongated end cap that corresponds to the end cap 160 in FIG. 1B, which engages the end plate 124. The end cap assembly 500 is attached to an end cap body 510 which includes a tubular shaft 520 and a collar 530. The diameter of the shaft is less than the diameter of the collar. The tubular shaft and the collar are also concentric. The tubular shaft may be hollow, and additional components may be placed therein if desired. Also illustrated here are fasteners 540 which pass through the side of the shaft 520 and into the radial apertures 474, to attach the end cap assembly to the end cap body 510. Alternatively, the end cap assembly may be press-fitted into the tubular shaft 520.

It is noted that other embodiments of the end cap assembly are contemplated. For example, referring to FIG. 7, the electrical contact attachment is on the "outside" of the end cap, or put another way the main cap 400 is between the contact attachment 200 and the collar 530 of the end cap body 510. The main cap structure can be modified so the contact attachment is on the "inside" of the end cap, between the main cap 400 and the collar 530. This could be done, for example, by placing the contact attachment against the rear surface 418 of the main cap, and permitting the electrically conductive through-pin of the tandem sub to pass entirely through the main cap pin bore. The cylindrical sidewall 472 and radial walls 476 could be deleted or moved to the front surface of the main cap.

In the depicted embodiment, the cover cap forms an outer surface 512 of the end cap. Alternatively, if the end cap assembly of FIG. 5 (lacking a cover cap) is used, the contact attachment might be exposed on the outer surface of the end cap. Similarly, in some other embodiments the main cap may form the outer surface of the end cap.

Figure 8:
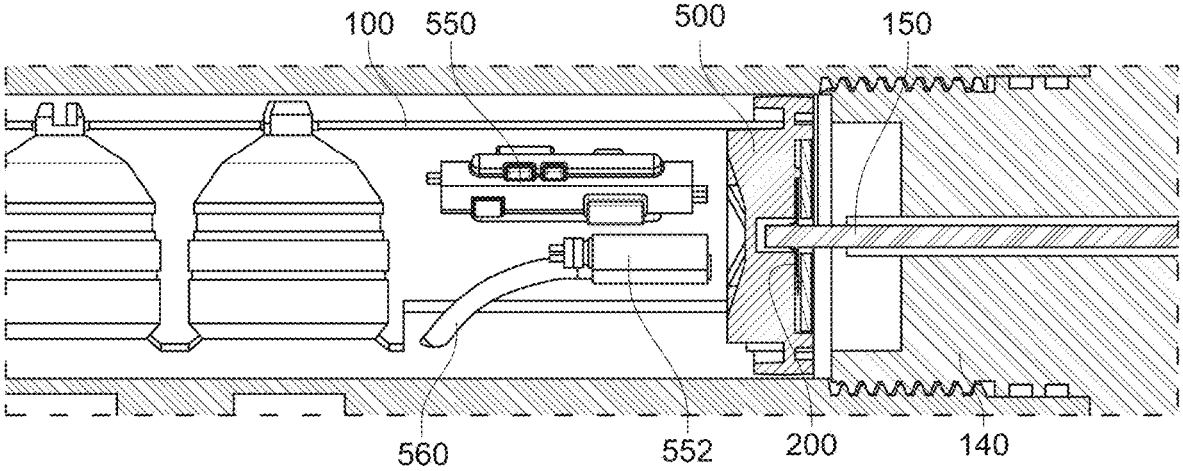
FIG. 8 is a side cross-sectional view showing a tandem sub with an electrically conductive through-pin engaging the end cap assembly, along with a portion of the charge carrier.

FIG. 8 is a side cross-sectional view showing a tandem sub 140 with an electrically conductive through-pin 150 engaging the end cap assembly 500, along with a portion of the charge carrier 120. In this embodiment, no end cap body is present. Instead, the end cap assembly forms the entirety of the end cap. Comparing FIG. 8 with FIG. 1B, in FIG. 8 the end cap assembly 500 replaces the end plate 124 and the end cap 160 entirely.

As seen here, the through-pin 150 engages the electrical contact attachment 200. The through-pin passes through the pin aperture and is engaged by the pin contact tabs. Also visible is an addressable switch 550, which can be located within the tubular shaft of the charge carrier 100 of the barrel. Two wires extend from the addressable switch. One of the wires from the addressable switch runs to the detonator. A detonator block 552 holds the detonator next to the detonating cord 560.

The present disclosure has been described with reference to exemplary embodiments. Modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. An end cap apparatus for a perforating gun, comprising:

a main cap having a pin bore; and an electrical contact attachment comprising a body having a pin aperture therethrough and at least one pin contact tab within the pin aperture that extends away from the body;

wherein the electrical contact attachment is affixed to the main cap such that the main cap pin bore and the electrical contact attachment pin aperture are concentric.

2. The apparatus of claim 1, wherein the body of the contact attachment further comprises a wire insert aperture proximate a first end of the body for passing an associated wire therethrough.

3. The apparatus of claim 1, wherein the body of the contact attachment has a mounting aperture disposed on the body proximate to the first end.

4. The apparatus of claim 3, wherein the mounting aperture has a larger diameter than the wire insert aperture.

5. The apparatus of claim 3, wherein the mounting aperture engages a mounting anchor of the main cap.

6. The apparatus of claim 3, wherein a fastener passes through the mounting aperture to engage the main cap.

7. The apparatus of claim 1, wherein the body of the contact attachment further comprises a cut-out disposed on a perimeter of the body, for engaging an associated wire.

8. The apparatus of claim 1, wherein a front surface of the main cap further comprises an annular perimeter wall surrounding a recessed central surface, the electrical contact attachment being affixed to the recessed central surface.

9. The apparatus of claim 8, wherein the main cap further comprises arcuate collars extending from a perimeter of a rear surface of the main cap.

10. The apparatus of claim 8, wherein the main cap further comprises a cylindrical sidewall extending from a rear surface of the main cap which surrounds the pin bore.

11. The apparatus of claim 10, wherein the main cap further comprises radial walls extending radially between the cylindrical sidewall and a wall surrounding the main cap pin bore.

12. The apparatus of claim 1, wherein a front surface of the main cap further comprises circumferentially spaced fastener openings, a wire passthrough opening, and a ridge that defines a contact attachment dock.

13. The apparatus of claim 1, further comprising a cover cap, wherein the cover cap secures the electrical contact attachment to the main cap.

14. The apparatus of claim 13, wherein the cover cap also includes a pin aperture that is concentric with the main cap pin bore and the electrical contact attachment pin aperture.

15. The apparatus of claim 13, wherein the cover cap further comprises circumferentially spaced fasteners extending from a body of the cover cap, the fasteners engaging fastener openings in the main cap.

16. The apparatus of claim 13, wherein the cover cap has a thickness that is about equal to a height of an annular perimeter wall surrounding a recessed central surface of the main cap.

17. The apparatus of claim 1, wherein the electrical contact attachment is exposed on an outer surface of the end cap.

18. The apparatus of claim 1, wherein the main cap forms an outer surface of the end cap.

19. An electrical contact attachment for a perforating gun, comprising:

a rectangular body having a first end longitudinally spaced from a second end, and a front surface and a rear surface;

a wire insert aperture passing through the body proximate the first end;

a mounting aperture passing through the body proximate the first end and longitudinally spaced apart from the wire insert aperture, the mounting aperture having a larger diameter than the wire insert aperture;

a cut-out disposed on a perimeter of the body;

a pin aperture passing through the body proximate the second end; and at least one pin contact tab surrounding the pin aperture, wherein the at least one pin contact tab bends towards the rear surface.

20. A perforating gun apparatus, comprising:

a gun barrel;

a charge carrier within the gun barrel, the charge carrier including an end cap; and a tandem sub engaging an end of the gun barrel, the tandem sub including an electrically conductive through-pin that engages the end cap;

wherein the end cap of the charge carrier comprises a main cap and an electrical contact attachment, the electrical contact attachment comprising a body having a pin aperture therethrough and at least one pin contact tab within the pin aperture that extends away from the body;

wherein the electrically conductive through-pin passes through the pin aperture and is engaged by the at least one pin contact tab.

* * * * *